US012359420B2

(12) United States Patent
Richards

(10) Patent No.: US 12,359,420 B2
(45) Date of Patent: Jul. 15, 2025

(54) STRUCTURAL FUSES AND CONNECTION SYSTEMS INCLUDING THE SAME

(71) Applicant: Durafuse Frames, LLC, West Jordan, UT (US)

(72) Inventor: Paul Williams Richards, Orem, UT (US)

(73) Assignee: Durafuse Frames, LLC, West Jordan, UT (US)

( * ) Notice: Subject to any disclaimer, the term of this patent is extended or adjusted under 35 U.S.C. 154(b) by 286 days.

(21) Appl. No.: 17/715,429

(22) Filed: Apr. 7, 2022

(65) Prior Publication Data

US 2022/0333369 A1 Oct. 20, 2022

Related U.S. Application Data

(60) Provisional application No. 63/174,706, filed on Apr. 14, 2021.

(51) Int. Cl.
*E04B 1/24* (2006.01)

(52) U.S. Cl.
CPC .... *E04B 1/2403* (2013.01); *E04B 2001/2415* (2013.01); *E04B 2001/2442* (2013.01); *E04B 2001/2457* (2013.01); *E04B 2001/2496* (2013.01)

(58) Field of Classification Search
CPC ..... E04B 1/2403; E04B 2001/2415; E04B 2001/2442; E04B 2001/2457; E04B 2001/2496
See application file for complete search history.

(56) References Cited

U.S. PATENT DOCUMENTS

| | | | |
|---|---|---|---|
| 1,727,293 | A | 9/1929 | Larkin |
| 4,014,089 | A | 3/1977 | Sato et al. |
| 4,926,592 | A | 5/1990 | Nehls |
| 5,148,642 | A | 9/1992 | Plumier et al. |
| 5,660,017 | A | 8/1997 | Houghton |
| 6,073,405 | A | 6/2000 | Kasai et al. |

(Continued)

FOREIGN PATENT DOCUMENTS

| | | | |
|---|---|---|---|
| CN | 109723145 | A | 5/2019 |
| EP | 3387196 | B1 | 11/2020 |

(Continued)

OTHER PUBLICATIONS

Non-Final Office Action for U.S. Appl. No. 17/715,418 mailed Sep. 22, 2023.

(Continued)

*Primary Examiner* — Rodney Mintz
(74) *Attorney, Agent, or Firm* — Dorsey & Whitney LLP

(57) ABSTRACT

Embodiments are directed to structural fuses and connection systems including the same. An example structural fuse includes at least one plate. The structural fuse includes a plurality of cutouts formed in the plate. The cutouts are configured to cause at least one first yield region of the plate to yield when a first load is applied to the plate. Optionally, the plurality of cutouts are configured to cause at least one second yield region to yield when a second load is applied to the plate. At least a portion of the first yield region is distinct from at least a portion of the second yield region and the first load is different than the second load.

20 Claims, 10 Drawing Sheets

(56) References Cited

U.S. PATENT DOCUMENTS

| | | | | |
|---|---|---|---|---|
| 6,138,427 | A | 10/2000 | Houghton | |
| 6,264,162 | B1 | 7/2001 | Barnes et al. | |
| 6,739,099 | B2 | 5/2004 | Takeuchi et al. | |
| 7,040,069 | B2 * | 5/2006 | Simmons | E04B 1/2403 52/837 |
| 7,530,205 | B2 * | 5/2009 | Simmons | E04C 3/04 52/837 |
| 8,683,758 | B2 * | 4/2014 | Christopoulos | E04H 9/0237 248/560 |
| 8,800,239 | B2 | 8/2014 | Yang | |
| 8,875,452 | B2 | 11/2014 | Kawai et al. | |
| 9,091,065 | B2 | 7/2015 | Tran et al. | |
| 9,163,424 | B2 * | 10/2015 | Montgomery | E04H 9/14 |
| 9,200,442 | B2 | 12/2015 | Richards | |
| 9,441,360 | B2 * | 9/2016 | Matteson | E04B 1/388 |
| 9,464,427 | B2 * | 10/2016 | Karns | E04H 9/024 |
| 9,506,239 | B2 | 11/2016 | Houghton | |
| 9,514,907 | B2 * | 12/2016 | McManus | E04H 9/0237 |
| 10,316,507 | B2 | 6/2019 | Richards | |
| 10,584,477 | B2 | 3/2020 | Richards | |
| 10,669,718 | B2 * | 6/2020 | Pryor | E04C 3/38 |
| 10,689,876 | B2 | 6/2020 | Richards | |
| 10,760,261 | B2 | 9/2020 | Richards | |
| 11,162,260 | B2 * | 11/2021 | Pryor | E04H 9/024 |
| 11,479,988 | B2 | 10/2022 | Curtis | |
| 11,808,026 | B2 * | 11/2023 | Zhao | E04B 1/2403 |
| 2002/0184836 | A1 | 12/2002 | Takeuchi et al. | |
| 2004/0050013 | A1 | 3/2004 | Okada et al. | |
| 2004/0200178 | A1 | 10/2004 | Simmons | |
| 2004/0237456 | A1 * | 12/2004 | Simmons | E04C 3/04 52/837 |
| 2005/0055970 | A1 * | 3/2005 | Simmons | E04B 1/2403 52/837 |
| 2005/0204684 | A1 | 9/2005 | Houghton | |
| 2006/0144006 | A1 | 7/2006 | Suzuki et al. | |
| 2006/0265992 | A1 | 11/2006 | Hiragaki | |
| 2009/0223166 | A1 | 9/2009 | Ohata et al. | |
| 2010/0205876 | A1 * | 8/2010 | Christopoulus | E04H 9/024 52/698 |
| 2010/0205891 | A1 | 8/2010 | Bong et al. | |
| 2011/0030305 | A1 | 2/2011 | Karns | |
| 2012/0017523 | A1 | 1/2012 | Ozaki et al. | |
| 2013/0074427 | A1 * | 3/2013 | Kawai | E04H 9/0237 188/371 |
| 2014/0062648 | A1 | 3/2014 | Mcmanus et al. | |
| 2014/0182234 | A1 | 7/2014 | Yang | |
| 2014/0325932 | A1 | 11/2014 | Karns et al. | |
| 2015/0096244 | A1 | 4/2015 | Richards | |
| 2015/0101268 | A1 * | 4/2015 | Montgomery | E04H 9/14 52/167.1 |
| 2015/0275501 | A1 | 10/2015 | Houghton | |
| 2016/0208478 | A1 * | 7/2016 | Matteson | E04H 9/0237 |
| 2016/0215492 | A1 * | 7/2016 | Karns | E04C 3/04 |
| 2016/0356033 | A1 | 12/2016 | Houghton et al. | |
| 2017/0268252 | A1 * | 9/2017 | Gray | E04H 9/025 |
| 2018/0266099 | A1 | 9/2018 | Lippert | |
| 2018/0274223 | A1 | 9/2018 | Richards | |
| 2018/0347222 | A1 | 12/2018 | Richards | |
| 2019/0040645 | A1 | 2/2019 | Zhao et al. | |
| 2019/0292783 | A1 | 9/2019 | Pryor et al. | |
| 2020/0109556 | A1 | 4/2020 | Pryor | |
| 2021/0079681 | A1 | 3/2021 | Pryor et al. | |
| 2022/0154445 | A1 | 5/2022 | Zhao et al. | |
| 2022/0333397 | A1 | 10/2022 | Richards | |
| 2023/0058224 | A1 * | 2/2023 | Evans | E04B 1/2608 |
| 2023/0110886 | A1 * | 4/2023 | Abela | E04B 1/2403 52/167.1 |
| 2023/0117355 | A1 * | 4/2023 | Robinson | E04H 9/024 52/167.1 |
| 2023/0175248 | A1 * | 6/2023 | Richards | E04B 1/2403 52/167.1 |
| 2024/0392567 | A1 * | 11/2024 | Felix | E04B 1/30 |

FOREIGN PATENT DOCUMENTS

| | | | |
|---|---|---|---|
| JP | 2000144901 | A | 5/2000 |
| JP | 2002364068 | A | 12/2002 |
| JP | 2006233445 | A | 9/2006 |
| JP | 6876510 | B2 | 4/2021 |
| KR | 20040106829 | A | 12/2004 |
| KR | 100516332 | B1 | 9/2005 |
| KR | 101344813 | B1 | 12/2013 |
| KR | 20140039385 | A | 4/2014 |
| KR | 101406485 | B1 | 7/2014 |
| KR | 20140105643 | A | 9/2014 |
| WO | 2014085680 | A1 | 6/2014 |
| WO | 2016036564 | A1 | 3/2016 |
| WO | 2017100453 | A1 | 6/2017 |
| WO | 2019040297 | A1 | 2/2019 |
| WO | 2021030111 | A1 | 2/2021 |

OTHER PUBLICATIONS

Corrected Notice of Allowance for U.S. Appl. No. 15/500,991 mailed May 8, 2019.
Corrected Notice of Allowance for U.S. Appl. No. 16/394,665 mailed Feb. 11, 2020.
International Search Report and Written Opinion from International Application No. PCT/US2015/047006 mailed Nov. 23, 2015.
International Search Report and Written Opinion from International Application No. PCT/US2016/065623 mailed Mar. 10, 2017.
International Search Report and Written Opinion from International Application No. PCT/US2018/046222 mailed Nov. 14, 2018.
International Search Report and Written Opinion from International Application No. PCT/US2020/044982 mailed Oct. 26, 2020.
Issue Notification for U.S. Appl. No. 15/500,991 mailed May 22, 2019.
Issue Notification for U.S. Appl. No. 15/516,834 mailed Aug. 12, 2020.
Issue Notification for U.S. Appl. No. 16/394,665 mailed Feb. 19, 2020.
Non-Final Office Action for U.S. Appl. No. 15/500,991 mailed Jan. 18, 2018.
Non-Final Office Action for U.S. Appl. No. 15/516,834 mailed Aug. 30, 2018.
Non-Final Office Action for U.S. Appl. No. 16/101,075 mailed Jun. 27, 2019.
Notice of Allowance for U.S. Appl. No. 15/500,991 mailed Jun. 18, 2018.
Notice of Allowance for U.S. Appl. No. 15/500,991 mailed Oct. 2, 2018.
Notice of Allowance for U.S. Appl. No. 15/516,834 mailed Apr. 1, 2020.
Notice of Allowance for U.S. Appl. No. 15/516,834 mailed Dec. 23, 2019.
Notice of Allowance for U.S. Appl. No. 15/516,834 mailed Jun. 26, 2019.
Notice of Allowance for U.S. Appl. No. 15/516,834 mailed Mar. 8, 2019.
Notice of Allowance for U.S. Appl. No. 16/101,075 mailed Feb. 2020.
Notice of Allowance for U.S. Appl. No. 16/394,665 mailed Oct. 30, 2019.
Supplemental Notice of Allowability for U.S. Appl. No. 15/516,834 mailed Apr. 29, 2020.
Supplemental Notice of Allowability for U.S. Appl. No. 16/101,075 mailed May 28, 2020.
U.S. Appl. No. 15/500,991, filed Feb. 1, 2017.
U.S. Appl. No. 15/516,834, filed Apr. 4, 2017.
U.S. Appl. No. 17/633,677, filed Feb. 8, 2022.
U.S. Appl. No. 62/044,738, filed Sep. 2, 2014.
U.S. Appl. No. 62/265,362, filed Dec. 9, 2015.
U.S. Appl. No. 62/549,853, filed Aug. 24, 2017.
U.S. Appl. No. 62/884,901, filed Aug. 9, 2019.
U.S. Appl. No. 63/174,663, filed Apr. 14, 2021.
U.S. Appl. No. 63/174,706, filed Apr. 14, 2021.

(56) References Cited

OTHER PUBLICATIONS

Advisory Action for U.S. Appl. No. 17/715,418 mailed Jun. 13, 2024.
Final Office Action for U.S. Appl. No. 17/715,418 mailed Apr. 1, 2024.
Non-Final Office Action for U.S. Appl. No. 17/715,418 mailed Aug. 15, 2024.
Restriction Requirement for U.S. Appl. No. 17/633,677 mailed Oct. 8, 2024.

* cited by examiner

STRUCTURAL FUSES AND CONNECTION SYSTEMS INCLUDING THE SAME

CROSS-REFERENCE TO RELATED APPLICATION

This application claims priority to U.S. Provisional Patent Application No. 63/174,706 filed on Apr. 14, 2021, the disclosure of which is incorporated herein, in its entirety, by this reference.

BACKGROUND

In buildings and other large structure, various components (e.g., beams, columns, braces, and/or walls) are connected to each other. The parts of the building and the connections between them are designed so they will not fail catastrophically under the expected loads. The load effects that are transmitted from one part to another include: axial forces, shear forces, and bending moments.

When designing structures to resist severe earthquakes or wind loads, engineers may rely on ductility to prevent catastrophic failure. Engineers may design certain parts of the building to yield in a controlled manner in order to accommodate the large movements associated with severe earthquake or wind loads. The parts of the structure that are typically designed to yield in a controlled manner are beams, braces, walls, and/or columns.

In order to control yielding, engineers may designate a yielding component (such as a brace or beam) and then design all the associate components to be stronger. This approach is called "capacity based" design. Sometimes a yielding component is oversized due to certain requirements, and then "capacity based" design has a cascading effect, resulting in oversizing all associate components. This may lead to structures that are expensive to construct.

After a severe earthquake or wind, the parts of the structure that have been yielded may require repair. Past experience has demonstrated that it is difficult to remove and replace structural components likes beams, braces, walls, and columns. In many cases, it is impractical to repair the buildings. Thus, current deign methods result in buildings that are safe for severe earthquakes and wind (i.e., the buildings will not collapse), but are not resilient (i.e., the buildings may have to be demolished because they are difficult to repair).

Some design procedures determine structural capacity based on the loads that can be carried when a "collapse mechanism" forms. This is known as "plastic design." Plastic design procedures are only valid when the structural components have certain cross-sectional characteristics that will enable them to yield without experiencing instability. Some structures, particularly those known as "metal buildings" have member cross-sectional characteristics that disqualify them for plastic design.

SUMMARY

Embodiments are directed to structural fuses and connection systems including the same. In an embodiment, a structural fuse is disclosed. The structural fuse includes at least one plate and at least one first cutout formed in the at least one plate. The at least one first cutout is configured to form at least one first yield region. The at least one first yield region configured to preferentially yield when a first load is applied to the plate. The structural fuse also includes at least one second cutout formed in the at least one plate. The at least one second cutout is configured to form at least one second yield region. The at least one second yield region is configured to preferentially yield when a second load is applied to the plate. At least a portion of the at least one first yield region is distinct from at least a portion of the at least one second yield region. The first load is different the second load.

In an embodiment, a frame is disclosed. The frame includes a first component, a second component, and a connection system attaching the first component to the second component. The connection system includes at least one structural fuse. The at least one structural fuse includes at least one plate and at least one first cutout formed in the at least one plate. The at least one first cutout is configured to form at least one first yield region. The at least one first yield region configured to preferentially yield when a first load is applied to the plate. The at least one structural fuse also includes at least one second cutout formed in the at least one plate. The at least one second cutout is configured to form at least one second yield region. The at least one second yield region is configured to preferentially yield when a second load is applied to the plate. At least a portion of the at least one first yield region is distinct from at least a portion of the at least one second yield region. The first load is different the second load. The first component and the second component are independently selected from a beam, a column, or a wall plate.

In an embodiment, a frame is disclosed. The frame includes a first component, a second component, and a connection system attaching the first component to the second component. The connection system includes at least one structural fuse. The at least one structural fuse includes at least one plate and at least one first cutout formed in the at least one plate. The at least one first cutout is configured to form at least one first yield region. The at least one first yield region is configured to preferentially yield when a first load is applied to the plate. The first component is a beam and the second component is a beam or a wall plate Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Figure 1A:
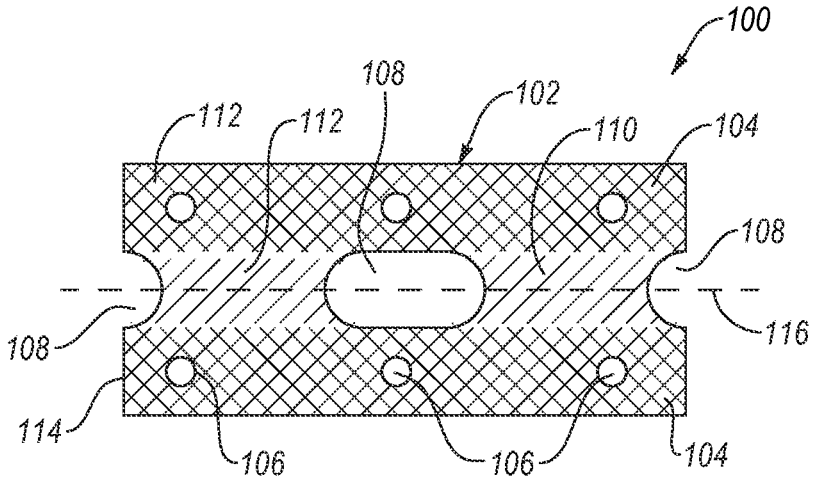
FIG. 1A is a top plan view of a structural fuse, according to an embodiment.

Embodiments are directed to structural fuses and connection systems including the same. An example structural fuse includes at least one plate. The structural fuse includes a plurality of cutouts formed in the plate. The cutouts are configured to cause at least one first yield region of the plate to yield when a first load is applied to the plate. In some embodiments, the plurality of cutouts are configured to cause at least one second yield region to yield when a second load is applied to the plate. At least a portion of the first yield region is distinct from at least a portion of the second yield region and the first load is different than the second load.

The structural fuses disclosed herein are configured to preferentially absorb and dissipate energy from a load by preferentially yielding. As used herein, "yield," "yielding," and "yielded" may refer to failing, fracturing, plastically deforming, or otherwise damaging an element (e.g., structural fuse) in a manner that may or may not require the replacement of the element after failure. Examples of loads that may cause yielding of the structural fuses includes loads caused by a seismic event or wind.

The structural fuses disclosed herein may be used in a frame (e.g., a moment-resisting frame, a beam-to-beam connection, a column-to-column connection, a beam-to-column connection, a frame including a collector, an eccentrically braced frame, a steel-plate shear wall building, etc.). The frame may include one or more generally horizontal beams, one or more generally vertical columns, one or more generally obliquely angled braces, a wall plate, or one or more connections that are configured to attach the beams, columns, braces, and/or wall plates together. The frame may form part of or an entirety of a structure (e.g., building). The structural fuses may absorb and dissipate some of the energy of loads applied to the frame which may prevent or avoid yielding of the other elements of the frame (e.g., beam, column, brace, plate wall, connections, etc.) that may otherwise result from the load. As such, the structural fuses disclosed herein may move yielding from the other elements of the frame to the structure fuses to minimize yielding of the other components of the frame. The structural fuses disclosed herein may also be easier to replace after absorbing and dissipating energy from the load than if the other elements of the frame yielded. In other words, the structural fuses may limit the amount of load that may develop in the other elements of the frame thereby preventing damage to such other elements of the frame and making structures that include the frame easier to repair after the load is applied thereto. Further, the structural fuses disclosed herein are proportioned and positioned to yield such that large deformations may occur in the frame to absorb and dissipate energy from the load without losing strength in the structure that includes the frame. As such, the structural fuses disclosed herein may prevent the oversizing of the beams, columns, braces, and wall plates that may occur in a capacity based design and/or can be used to insert a plastic hinge location into the frame that would be otherwise disqualified for plastic design. Thus, the structural fuses may result in more economical design in some structures.

FIG. 1A is a top plan view of a structural fuse 100, according to an embodiment. The structural fuse 100 includes a single plate 102. The plate 102 includes one or more connection regions 104 that are configured to be attached to other components of a frame, such as a beam and/or column. For illustrative purposes, the connection regions 104 of the plate 102 are illustrated in FIG. 1A using intersecting diagonal lines. The connection regions 104 may be configured to be attached to the other components of the frame using any suitable technique. In an example, as illustrated, the connection regions 104 may be configured to be connected to the other components of the frame using one or more bolts and nuts or rivets. In such an example, the connection regions 104 may define one or more holes 106 through which the bolts or rivets may be inserted. In an example, the connection regions 104 may be configured to be connected to the other components of the frame via welding. In such an example, the connection regions 104 of the plate 102 does not define one or more holes therein.

The structural fuse 100 includes at least one cutout 108 formed in the plate 102. The cutout 108 are configured to weaken the plate 102 such that the plate 102 yields in selected regions of the plate 102. For example, the cutout 108 is configured such that the plate 102 yields in one or more yield regions 110. At least a portion (e.g., majority or all) of the yield regions 110 are distinct from at least a portion (e.g., majority or all) of the connection regions 104. As such, failure of plastic deformation of the yield regions 110 of the plate 102 are unlikely to affect the connection between the plate 102 and the other elements of the frame to which the structural fuse 100 is attached. For illustrative purposes, the yield regions are illustrated in FIG. 1A using non-intersecting diagonal lines.

The plate 102 may include a top surface 112 and a bottom surface (not shown) opposite the top surface 112. In an embodiment, the cutout 108 may include an opening formed in the plate 102 that extends from the top surface 112 to the bottom surface. In other words, the cutout 108 may extend completely through the plate 102. When the cutout 108 extends completely through the plate 102, the cutout 108 is distinguishable from the holes 106 that are configured to receive the bolts or rivets by the size of the cutout 108. In an example, the cutout 108 exhibits a maximum lateral dimension or area that is significantly larger (e.g., at least 2 times larger, at least 5 times larger, or at least 10 times larger) than maximum lateral dimension or area the holes 106, respectively. In an example, the cutout 108 exhibits a maximum lateral dimension that is significantly larger (e.g., about 1.5 cm or greater, about 2 cm or greater, about 3 cm or greater, about 4 cm or greater, about 5 cm or greater, about 7.5 cm or greater, or 10 cm or greater) than the maximum lateral dimension of the holes 106. The cutout 108 may be significantly larger than the holes 106 since the cutout 108 is configured to selectively weaken the plate 102 whereas the holes 106 are configured to have a negligible effect on the strength of the plate 102. In an example, the cutout 108 may be distinguishable from the holes 106 because the cutout 108 exhibits a non-circular shape (e.g., elongated or square shape) while the holes 106 are circular. In an embodiment, the cutout 108 may extend from the top surface 112 to an intermediate location between the top surface 112 and the bottom surface. In other words, the cutout 108 may be a selectively thinned region of the plate 102.

The cutout 108 may extend inwardly from an edge 114 of the plate 102 or may be completely surrounded from the plate 102. In an example, the at least one cutout 108 may include a single cutout 108 that is completely surrounded by the plate 102. In an example, the at least one cutout 108 includes a single cutout 108 that extends inwardly from one edge 114 of the plate 102. In an example, the at least one cutout 108 includes a plurality of cutouts 108. In such an example, the plurality of cutouts 108 may extend inwardly from at least one edge 114 of the plate 102, be completely surrounded by the plate 102, or both (e.g., at least one cutout 108 extends inwardly from the edge 114 while at least one other cutout 108 is surrounded by the plate 102).

The cutout 108 may exhibit any suitable shape. Generally, the shape of the cutout 108 exhibits a generally rounded shape (e.g., circular or oblong shape) to prevent stress concentrators, which may cause the structural fuse 100 to fail or plastically deform at unsatisfactory low loads. However, the cutout 108 may exhibit a non-rounded shape, such as a rectangular or square shape. The stress concentrators (e.g., corners) of such non-rounded shapes may allow for more control of which portions of the plate 102 are the yield regions 110. In an example, the cutout 108 may exhibit a longitudinally extending shape, such as an oblong, ellipsoid, or rectangular shape. The longitudinally extending shape may weaken region of the plate 102 that are aligned with the longitudinal axis of the longitudinally extending shape of the cutout 108 thereby allowing for more control of which portions of the plate 102 are the yield region 110. That is, the yield regions 110 are the portions of the plate 102 that are aligned with the longitudinal axis of the cutout 108.

Figure 3A:
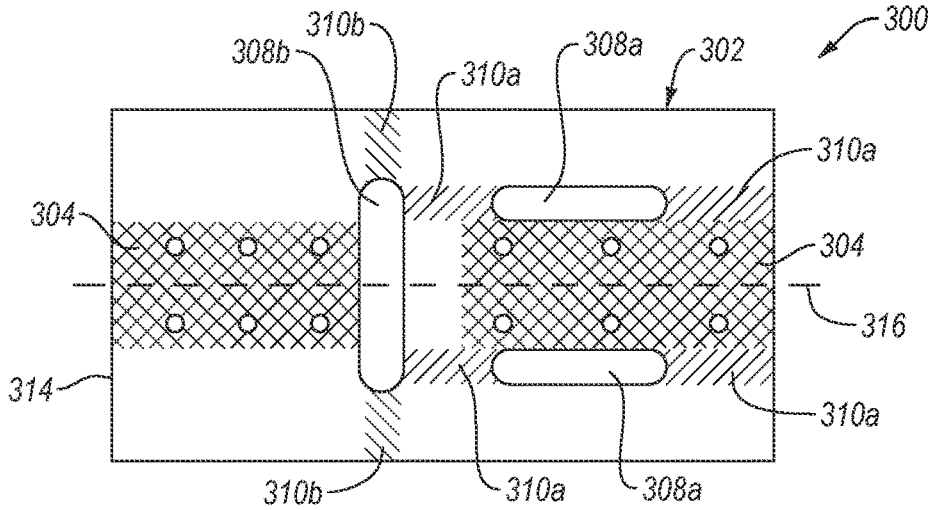
FIG. 3A is a top plan view of a structural fuse, according to an embodiment.
Figure 3B:
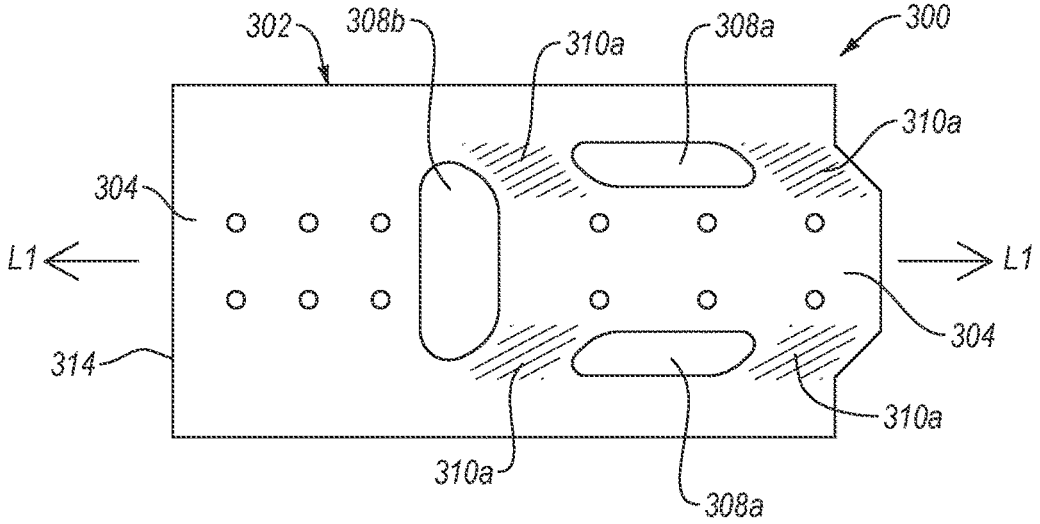
FIGS. 3B and 3C are top plan views of the structural fuse illustrated in FIG. 3A when the first load and the second load, respectively, are applied to the structural fuse, according to an embodiment.
Figure 3C:
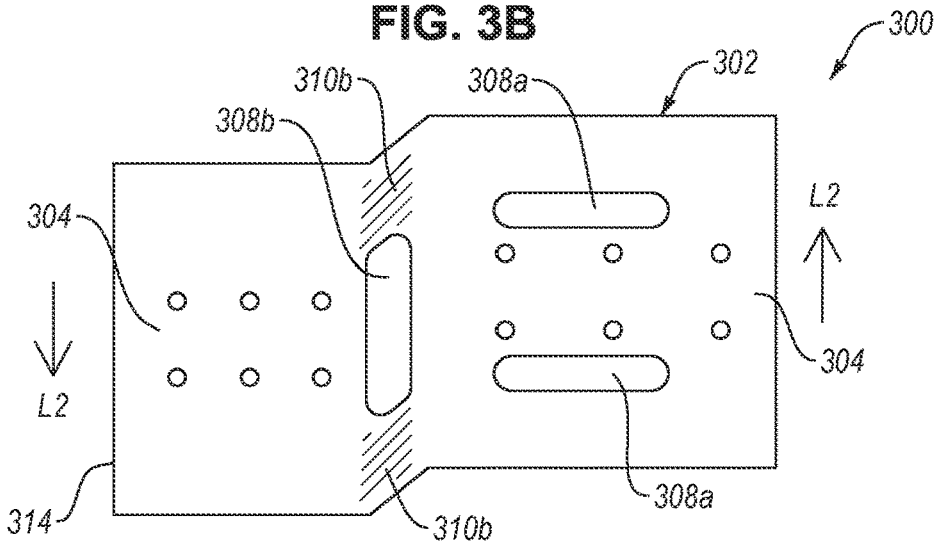

As previously discussed, the at least one cutout 108 may include a plurality of cutouts 108. In an embodiment, at least some of the plurality of cutouts 108 may be arranged on the plate 102 in a generally straight line. Arranging the plurality of cutouts 108 in a generally straight line causes the yield region 110 to be aligned and positioned on the generally straight line. In other words, the yield region 110 is located between the plurality of cutouts 108 arranged in the straight line. As such, arranging the plurality of cutouts 108 in a generally straight line may allow for better control of which portions of the plate 102 that are yield region 110. However, as illustrated in FIGS. 3A-3C, at least one of the plurality of cutouts 108 may not be arranged in a generally straight line.

As previously discussed, the plate 102 includes at least one yield region 110. The yield region 110 includes portions of the plate 102 that are weakened by the cutout 108 such that the yield region 110 preferentially yield when a load is applied to the plate 102. In an example, the at least one cutout 108 includes a plurality of cutouts 108 and the yield region 110 is between adjacent ones of the cutouts 108. In such an example, the yield region 110 is between the adjacent cutouts 108 because the adjacent cutouts 108 weaken a portion of the plate 102 between the cutouts 108. In an example, shown in FIGS. 2A-4C, the yield region 110 is between the cutout 108 and an edge 114 of the plate 102. For instance, the yield region 110 is between the cutout 108 and the edge 114 nearest the cutout 108.

The plate 102 may exhibit a major axis 116. The major axis 116 is generally aligned with a longitudinal axis of the beam or column to which the plate 102 is attached. Additionally or alternatively, the major axis 116 of the plate 102 may be the longitudinal axis of the plate when the plate 102 includes a longitudinal axis (e.g., the plate 102 is not square or circular). The yield region 110 may extend from the cutout 108 is an angle that is generally parallel to, generally perpendicular to, or oblique relative to the major axis 116 of the plate 102.

The direction that the yield region 110 extends from the cutout 108 effects which load applied to the structural fuse causes the yield region 110 to yield. For example, only loads that are generally parallel to the direction that the yield region 110 extends from the cutout 108 may cause the yield region 110 to yield. When a load is applied to the structural fuse 100 that is obliquely angled relative to the yield region 110, the obliquely angled load may be broken into a first load component that is generally parallel to the direction that the yield region 110 extends from the cutout 108 and a second load component that is perpendicular to the first load. The first load component may cause the yield region 110 to yield while the second load component is unlikely to cause the yield region 110 to yield.

Figure 1B:
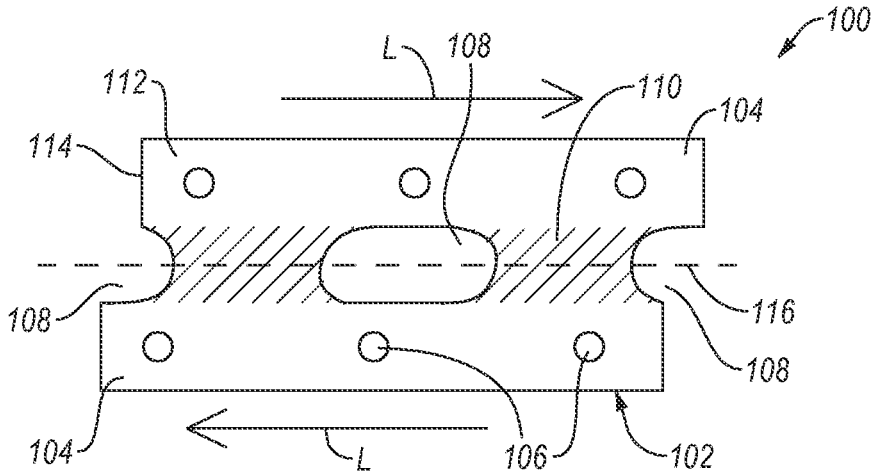
FIG. 1B is a top plan view of the structural fuse illustrated in FIG. 1A yielding.

Referring to FIG. 1B, which is a top plan view of the structural fuse 100 yielding, a load L may be applied to the structural fuse 100. The load L may be applied to the structural fuse 100 responsive to a load (e.g., seismic or wind load) being applied to a frame that includes the structural fuse 100. The load L is illustrated to be generally parallel to the major axis 116 and the direction that the yield region 110 extends from the cutout 108. The load L is sufficiently large to cause the plate 102 to yield at the yield regions 110 thereof since the load L is generally parallel to the direction that the yield region 110 extends from the cutout 108. The yielded yield regions 110 of the plate 102 are illustrated in FIG. 1B as being diagonal non-intersecting lines. Yielding the yield regions 110 of the plate 102 causes the structural fuse 100 to absorb and dissipate at least some of the energy from the load applied to the frame that includes the structural fuse 100, thereby decreasing the likelihood that other components of the frame yield in response to the load. Since the yield regions 110 are at least partially distinct from the connection regions 104, the load L does not cause the connection regions 104 of the plate 102 to yield which may adversely affect the attachment between the structural fuse 100 and the components of the frame to which the structural fuse 100 is attached.

The load L illustrated in FIG. 1B is a shear force that is generally parallel to the major axis 116 of the plate 102. However, the load L that causes the yield region 110 to yield may include a shear force that is not generally parallel to the major axis (as shown in FIGS. 3C and 4C); a tensile load that is parallel, perpendicular, or obliquely angled relative to the major axis 116; a compressive load, a bending moment, or any other load.

Figure 2A:
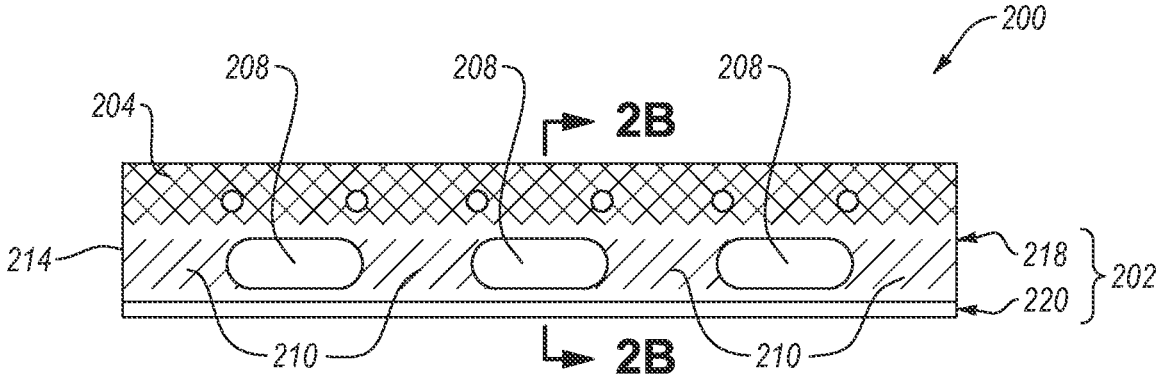
FIG. 2A is a top plan view of a structural fuse that is an angle, according to an embodiment.
Figure 2B:
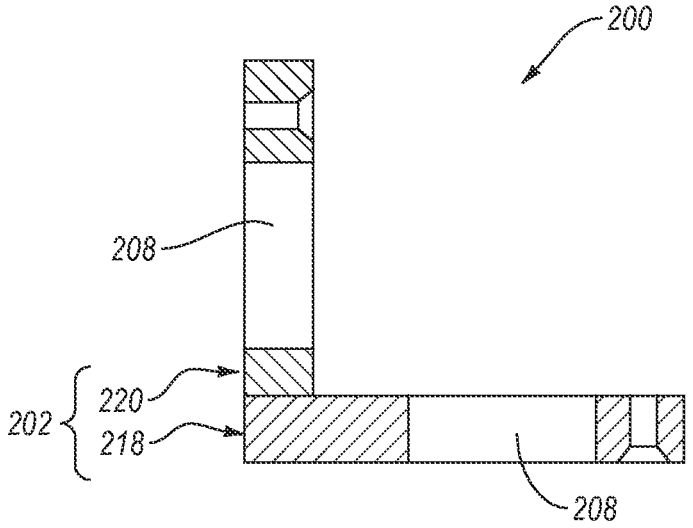
FIG. 2B is a cross-sectional schematic of the structural fuse taken along plane 2B-2B shown in FIG. 2A, according to an embodiment.
Figure 5A:
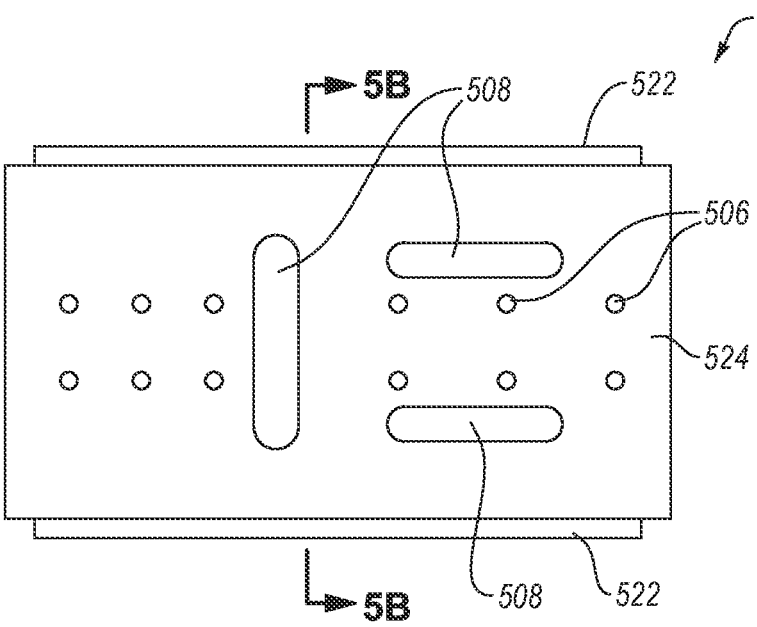
FIG. 5A is a side plan view of a component of a frame, according to an embodiment.
Figure 5B:
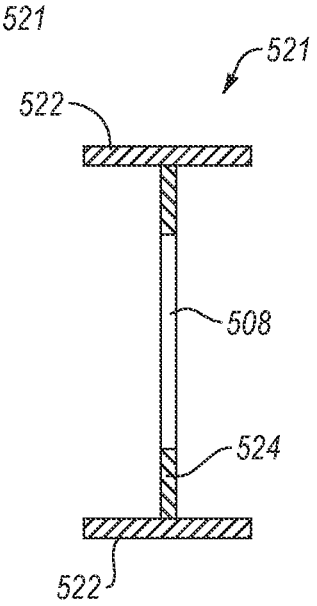
FIG. 5B is a cross-sectional schematic of the component taken along lines 5B-5B illustrated in FIG. 5A, according to an embodiment.

Referring back to FIG. 1A, the plate 102 may exhibit any suitable shape prior to the yield region 110 yielding. The shape of the plate 102 may be selected to minimize the size and weight of the structural fuse 100 while also allowing the structural fuse 100 to be attached to components to the frame. In an example, as illustrated, the plate 102 exhibits a generally rectangular shape. In an example, the plate 102 may exhibit a generally top-hat shape that includes a first rectangle and a second rectangle extending therefrom wherein width of the first rectangle is less than a width of the second rectangle. The generally top-hat shape of the plate 102 may allow the first rectangle to be attached to a flange of a beam while the second rectangle extends outwardly from the flange of the beam thereby facilitating attachment to an angle that is attached to a column (i.e., the structural fuse 100 forms part of a beam-to-column connection system). Examples of such connection is disclosed in U.S. Pat. No. 10,361,507 filed on Apr. 24, 2017, the disclosure of which is incorporated herein, in its entirety, by this reference. In an example, the plate 102 may exhibit a generally L-shape cross-section (as shown in FIGS. 2A-2C), a generally I-shaped cross-section (as shown in FIGS. 5A and 5B), or any other suitable shape.

As previously discussed, the structural fuses disclosed herein may exhibit a generally L-shaped cross-section. In other words, the structural fuses disclosed herein may be an angle. For example, FIG. 2A is a top plan view of a structural fuse 200 that is an angle, according to an embodiment. FIG. 2B is a cross-sectional schematic of the structural fuse 200 taken along plane 2B-2B shown in FIG. 2A, according to an embodiment. Except as otherwise disclosed herein, the structural fuse 200 may be the same or substantially similar to any of the structural fuses disclosed herein. For example, the structural fuse 200 may include at least one plate 202 that includes at least one connection region 204 (illustrated in FIG. 2A using intersecting diagonal lines), at least one cutout 208 formed in the plate 202, and at least one yield region 210 (illustrated in FIG. 2A using non-intersecting diagonal lines).

The plate 202 of the structural fuse 200 may be an angle. For example, the plate 202 may include a first section 218 and a second section 220. The first and second planar sections 218, 220 are illustrated as being generally planar though the first and second planar sections 218, 220 may be bent or curved. The first section 218 may be oriented at a perpendicular or oblique (e.g., acute or obtuse) angle relative to the second section 220 such that the plate 202 exhibits a generally L-like cross-sectional shape. In an embodiment, as illustrated, the first and second sections 218 are formed from two distinct plates that are attached (e.g., welded) together. In an embodiment, the plate 202 is formed from a single piece of material that is bent, extruded, or otherwise shaped to form the first and second sections 218, 220.

At least one of the first or second section 218, 220 may include at least one cutout 208 formed therein. For example, as shown in FIG. 2B, each of the first and second sections 218, 220 include at least one cutout 208 formed therein. The cutout 208 may be same or substantially similar to any of the cutouts disclosed herein and may be configured to form at least one yield region 210. The yield region 210 may extend between adjacent cutouts 208 and/or the edges 214 of the plate 202. As illustrated, the at least one cutout 208 of the structural fuse 200 forms yield regions 210 that are distinct from the connection regions 204 of the plates 202.

The structural fuses illustrated in FIGS. 1A-2B include at least one yield region that extends from the at least one cutout thereof in a single direction. As previously discussed, the yield region(s) of such structural fuses may yield when a load (or component of the load) is applied to the structural fuses that is generally parallel to the direction that the yield region(s) extend from the cutout. Thus, the structural fuses illustrated in FIGS. 1A-2B may absorb energy from a load applied to the structural fuses when the load or a component of the load is generally parallel to the direction that the yield regions extend from the cutouts. However, in an example, the load applied to the structural fuses in response to the load being applied to the frame is likely to vary such that the direction of the load applied to the structural fuses may not always be generally parallel to the direction that the yield regions extend from the cutouts. In such an example, the entire load or a component of the load may not be absorbed and dissipated by the structural fuse.

As such, in some embodiments, the structural fuses disclosed herein may be configured to include at least one first yield region that is configured to yield when a first load is applied to the structural fuse and at least one second yield region that is configured to yield when a second load is applied to the structural fuse. The first load and the second load are different from each other. For example, the first load and the second load may be at least one of different types of loads (e.g., shear and tensile loads), the same type of load applied at different directions to the structural fuse (e.g., parallel and perpendicular to the major axis of the structural fuse), or different components of the same load. FIGS. 3A to 4C illustrate structural fuses that include first and second yield regions that are configured to preferentially yield when two different loads are applied to the structural fuses.

FIG. 3A is a top plan view of a structural fuse, 300, according to an embodiment. Except as otherwise disclosed herein, the structural fuse 300 is the same or substantially similar to any of the structural fuses disclosed herein. For example, the structural fuse 300 includes at least one plate 302. The structural fuse 300 also includes at least one connection region 304 (illustrated using intersecting diagonal lines), a plurality of cutouts, and a plurality of yield regions (illustrated using non-intersecting diagonal lines).

The plurality of cutouts includes at least one first cutout 308*a* and at least one second cutout 308*b* and the plurality of yield regions includes at least one first yield region 310*a* and at least one second yield region 310*b*. The first cutout 308*a* is configured to form the first yield region 310*a* when a first load L1 (shown in FIG. 3B) is applied to the structural fuse 300. The second cutout 308*a* is configured to form the second yield region 310*b* when a second load L2 (shown in FIG. 3C) is applied to the structural fuse 300. It is noted that, optionally, the first cutout 308*a* may facilitate the formation of the second yield region 310*b* when the second load L2 is applied to structural fuse 300 and/or the second cutout 308*b* may facilitate the formation of the first yield region 310*a* when the second load L2 is applied to the structural fuse 300.

In the illustrated embodiment, the at least one first yield region 310*a* extends from the first cutout 308*a* in a first direction. The first direction is illustrated as being generally parallel to the major axis 316 of the plate 302 though the first direction may be oblique or perpendicular to the major axis 316. The first yield region 310*a* may extend from the first cutout 308*a* in the first direction because, for example, the first cutout 308*a* exhibits an elongated shape and the longitudinal axis of the elongated shape extends in the first direction. The direction that the first yield regions 310*a* extends from the first cutout 308*a* allows the first yield regions 310*a* to preferentially yield when the first load L1 is parallel to the first direction. As previously discussed, the first load L1 may be an entirety of a load applied to the structural fuse 300 or may be a component of a load that is generally parallel to the first direction when the load that forms the first load L1 is parallel or obliquely angled, respectively, to the first direction. The first cutout 308*a* is configured to cause the first yield regions 310*a* to extend therefrom in a direction that is generally parallel to the first direction by weakening the portions of the plate 302 that forms the first yield region 310*a*. In an example, as illustrated, the first cutout 308*a* may weaken a portion of the plate 302 that extends from the first cutout 308*a* to an edge 314 (e.g., a cross-wise edge) of the plate 302. In such an example, the first cutout 308*a* is spaced from the edge 314 and there is no additional first cutout 308*a* extending inwardly from the edge 314. In an example, as illustrated, the first cutout 308*a* and the second cutout 308*a* may weaken a portion of the plate 302 that extends from the first cutout 308*a* to the second cutout 308*b* in a direction that is generally parallel to the first direction. In an example, not shown, the first cutout 308*a* may extend inwardly from the edge 314 and/or the first cutout 308*a* may include a plurality of first cutouts 308*a* that are arranged in a lines, as previously discussed with regards to the cutouts illustrated in FIGS. 1A-2B. In such an example, the first yield region 310*a* may extend from such first cutouts 308*a* in a direction that is generally parallel to the first direction.

In an embodiment, the first yield region 308*a* may include a plurality of first yield regions 310*a* that are arranged in a line that is generally parallel to the first direction. In an embodiment, the first yield region 310*a* may include a plurality of first yield regions 310*a* that form two or more lines that are each generally parallel to the first direction. In such an embodiment, the two or more lines of the first yield regions 310*a* may facilitate yielding caused by a tensile load than if the plurality of first yield regions 310*a* were arranged in a single line.

In the illustrated embodiment, the at least one second yield region 310*b* extends from the second cutout 308*b* in a second direction that is different than the first direction. The second direction is illustrated as being generally perpendicular to the major axis 316 of the plate 302 through, it is noted, the second direction may be oblique or perpendicular to the major axis 316. The second yield region 310*b* may extend from the second cutout 308*b* in the second direction because, for example, the second cutout 308*b* exhibits an elongated shape and the longitudinal axis of the elongated shape extends in the second direction. The second yield regions 310*b* extending from the second cutout 308*b* in the second direction allows the second yield regions 310*b* to preferentially yield when the second load L2 is parallel to the second direction. As previously discussed, the second load L2 may be an entirety of a load applied to the structural fuse 300 or may be a component of a load that is generally perpendicular to the second direction when the load that forms the second load L2 is perpendicular or obliquely angled, respectively, to the second direction. The second cutout 308*b* is configured to cause the second yield regions 310*b* to extend therefrom in a direction that is generally parallel to the second direction by weakening the portions of the plate 302 that forms the second yield region 310*b*. In an example, as illustrated, the second cutout 308*b* may weaken a portion of the plate 302 that extends from the second cutout 308*b* to an edge 314 (e.g., a longitudinal edge) of the plate 302. In such an example, the second cutout 308*b* is spaced from the edge 314 and there is no additional second cutout 308*b* extending inwardly from the edge 314. In an example, not shown, the second cutout 308*b* may extend inwardly from the edge 314 and/or the second cutout 308*b* may include a plurality of second cutouts 308*b* that are arranged in lines, as previously discussed with regards to the cutouts illustrated in FIGS. 1A-2B. In an embodiment, similar to the first cutout 308*a*, the second cutout 308*b* may include a plurality of second cutouts 308*b* arranged in one or two or more lines.

FIGS. 3B and 3C are top plan views of the structural fuse 300 when the first load L1 and the second load L2, respectively, are applied to the structural fuse 300, according to an embodiment. Referring to FIG. 3B, the first load L1 may be applied to the structural fuse 300. As previously discussed, the first load L1 may be generally parallel to the first direction of the structural fuse 300. The first load L1, when sufficiently large, may cause the first yield regions 310*a* to yield. For illustrative purposes, the yielded first regions 310*a* are illustrated using diagonal lines. In an embodiment, as shown, the first load L1 is a tensile load. The first load L1 may be a tensile load when the connection regions 304 are spaced from each other in the first direction and the components of the frame to which the connection regions 304 are attached move apart from each other. When the first cutouts 308*a* are arranged in two lines, the tensile first load L1 may cause the yield regions 310*a* to elongated, as shown. However, it is noted that the first load L1 may be a compressive load, a shear load, or any other type of load applied to the structural fuse 300.

Referring to FIG. 3C, the second load L2 may be applied to the structural fuse 300. As previously discussed, the second load L2 may be generally parallel to the second direction. The second load L2, when sufficiently large, may cause the second yield regions 310*b* to yield. For illustrative purposes, the yielded second yield regions 310*b* are illustrated using diagonal lines. In an embodiment, as shown, the second load L2 is a shear load. The second load L2 may be a shear load when the connection regions 304 are spaced from each other in the first direction and the components of the frame to which the connection regions 304 are attached move sideways relative to each other. However, it is noted that the second load L2 may be a compressive load, a shear load, or any other type of load applied to the structural fuse 300.

Unlike the structural fuses illustrated in FIGS. 1A-2B, the structural fuse 300 may absorb and dissipate energy from two different loads, namely the first load L1 and the second load L2. For example, the structural fuses illustrated in FIGS. 1A-2B may only be able to absorb and dissipate energy from one of the first load L1 or the second load L2. The other of the first load L1 or second load L2 that is not absorbed by such structural fuses may be absorbed and dissipated by other components of the frame or by portions of such structural fuses that are not yield regions (e.g., the connection region). Yielding in portions of the frame other than the yield regions of the structural fuses may cause catastrophic failure of the frame, oversizing the elements of the frame, forming plastic hinges, or require complex and/or difficult repairs. However, the structural fuse 300 may be able to absorb and dissipate the energy from both the first and second loads L1, L2 thereby decreasing the likelihood that the frame fails, the frame needs oversized elements, or plastic hinges and/or may facilitate repair of the frame.

Figure 4A:
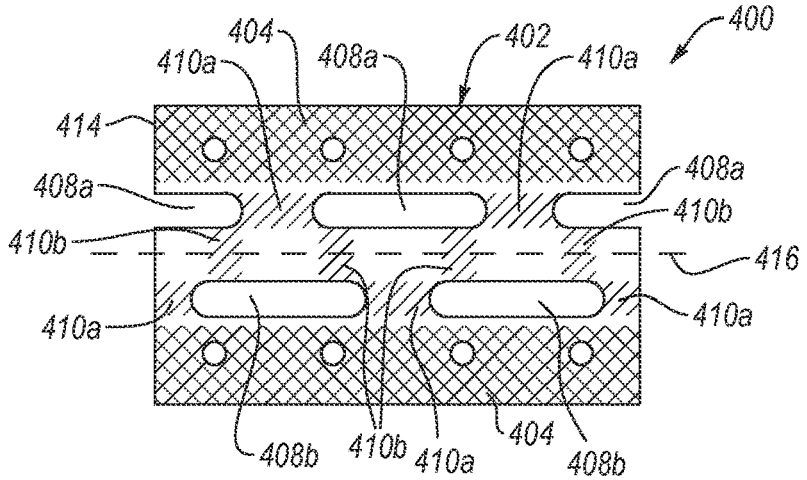
FIG. 4A is a top plan view of a structural fuse, according to an embodiment.

FIG. 4A is a top plan view of a structural fuse 400, according to an embodiment. Except as otherwise disclosed herein, the structural fuse 400 is the same or substantially similar to any of the structural fuses disclosed herein. For example, the structural fuse 400 includes at least one plate 402. The plate 402 includes one or more connection region 404 (illustrated using intersecting diagonal lines), a plurality of cutouts, and a plurality of yield regions (illustrated using non-intersecting diagonal lines). The structural fuse 400 is configured to absorb and dissipate energy from a first load L1 (shown in FIG. 4B) and a second load L2 (shown in FIG. 4C).

The plurality of cutouts includes at least one first cutout 408*a* and at least one second cutout 408*b*. The plurality of yield region include a plurality of first yield regions 410*a* and one or more second yield regions 410*b*. The first cutout 408*a* and the second cutout 408*b* are both configured to form the first yield regions 410*a* and the second yield regions 410*b*. The first yield regions 410*a* are configured to extend from the first and the second cutouts 408*a*, 408*b* in a first direction and the second yield regions 410*b* are configured to extend from the first and second cutouts 408*a*, 480*b* in a second direction that is different than the first direction. In an example, as shown, the first and second directions are generally parallel and perpendicular, respectively, to the major axis 416 of the plate 402. As such, the structural fuse 400 may be configured to absorb and dissipate energy in response to two different loads, such as the first load L1 and the second load L2.

The first cutout 408*a* and the first yield regions 410*a* extending therefrom are arranged in a first line that is generally parallel to the first direction. The second cutout 408*a* and the first yield regions 410*a* extending therefrom are arranged in a second line that is generally parallel to the first direction and offset relative to the first line. As such, the first and second cutouts 408, 408*b* weaken portions of the plate 402 between adjacent ones of the cutouts and/or cutouts and the edges 414 (e.g., cross-wise edges) of the plate 402. In an embodiment, the first and second cutouts 408*a*, 408*b* may exhibit longitudinal shapes and the longitudinal axes of the longitudinal shapes are aligned parallel to the first direction.

The first cutout 408*a* and the second cutout 408*b* are arranged on the first and second lines such that a portion of the first cutout 408*b* overlaps (in the second direction) with a portion of one or more of the second cutout 408*b* and vice versa. The second yield regions 410*b* extend between the overlapping portions of the first and second cutouts 408*a*, 408*b*. In other words, the first and second cutouts 408*a*, 408*b* weaken portions of the plate 402 between the overlapping portions of the first and second cutouts 408*a*, 408*b*.

Figure 4B:
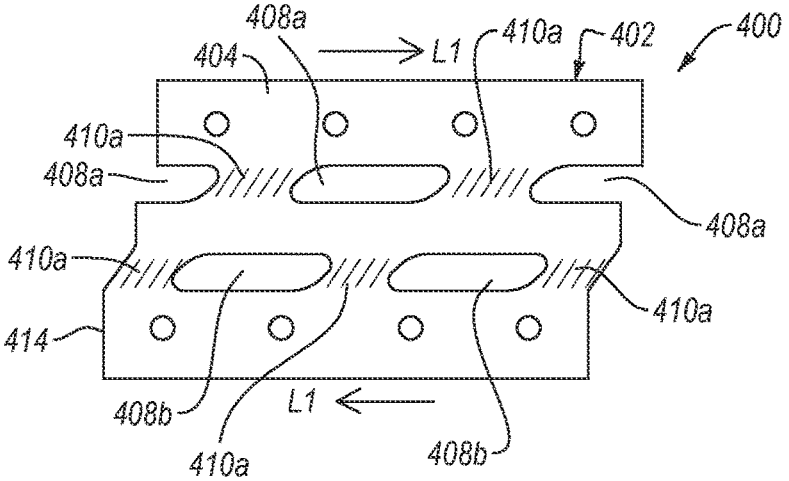
FIGS. 4B and 4C are top plan views of the structural fuse illustrated in FIG. 4A when the first load and the second load, respectively, are applied to the structural fuse, according to an embodiment.
Figure 4C:
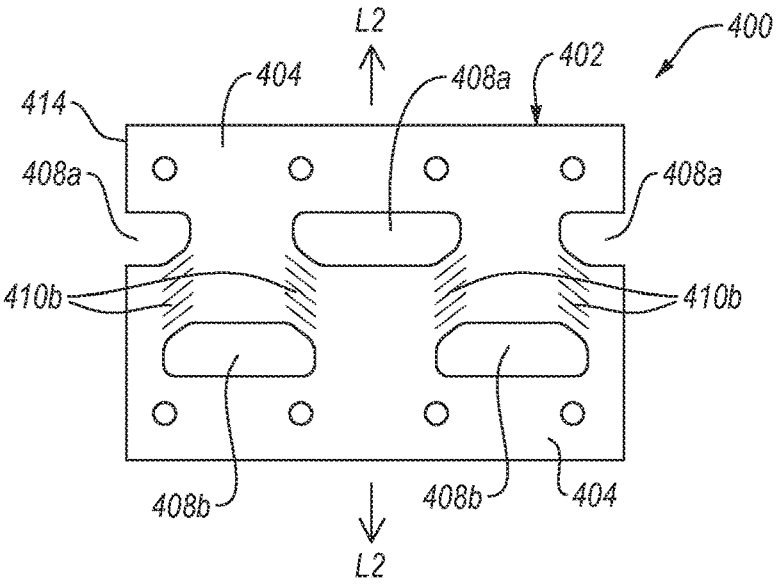

FIGS. 4B and 4C are top plan views of the structural fuse 400 when the first load L1 and the second load L2, respectively, are applied to the structural fuse 400, according to an embodiment. Referring to FIG. 4B, the first load L1 is applied to the structural fuse 400. The first load L1 may be generally parallel to the first direction (e.g., generally parallel to the major axis 416). The first load L1 is illustrated as being a shear load but, it is noted, the first load L1 may be a tensile load or any other type of load. The first load L1 causes the first yield regions 410*a* to yield. For illustrative purposes, the yielded yield regions 410*a* are illustrated using diagonal lines, Referring to FIG. 4C, the second load L2 is applied to the structural fuse 400. The second load L2 is different than the first load L1. For example, the second load L2 is applied to the structural fuse 400 in the second direction and is perpendicular to the first direction. The second load L2 is illustrated as being a tensile load but, it is noted, the second load L2 may be a shear load or any other type of load. The second load L2 causes the second yield regions 410*b* to yield. The illustrative purposes, the yielded yield regions 410*a* are illustrated using diagonal lines.

In some embodiment, the structural fuses illustrated in FIGS. 1A-4C are formed using one or more plates that are distinct from the other components of the frame, such as beams, columns, braces, etc. In such embodiments, the structural fuses may connect the other components of the frame. However, the structural fuses disclosed herein may be formed in one or more plates that are integrally formed with the other components of the frame. For example, the structural fuses disclosed herein may form at least a portion of the beams, columns, braces, wall plates, or other components of the frame. FIG. 5A is a side plan view of a component 521 of a frame (not shown), according to an embodiment. FIG. 5B is a cross-sectional schematic of the component 521 taken along lines 5B-5B illustrated in FIG. 5A, according to an embodiment.

The component 521 is formed from one or more plates. In an example, as illustrated, the component 521 is illustrates as an I-beam and the plates of the component 521 includes two flanges 522 and a web 524 extending between the two flanges 522. The flanges 522 and the web 524 may be attached together (e.g., via welding) or integrally formed (e.g., extruded). In an example, the component 521 may be a hollowed structural section beam, an L-beam, a T-beam, a channel, or any other structure used in frames. In such an example, the flanges, webs, etc. of such components form the plates of the component 521. In an embodiment, as illustrated, the component 521 may be configured to be attached to another component of the frame, such as a plate that attached the component 521 to a beam or column. In such an embodiment, the component 521 may define one or more holes 506 when the component 521 is attached to the other component using bolts.

One or more of the plates of the component 521 (e.g., one or more of the two flanges 522 or the web 524) defines at least one cutout 508. In the illustrated embodiment, the cutout 508 defined by the plate of the component 521 are arranged in the same manner as the cutouts illustrated in FIG. 3A. However, the cutout 508 may be arranged according to any of the embodiments disclosed herein. The cutout 508 formed on the plate of the component 521 forms yield regions that preferentially yield when a load is applied to the component 521. As such, the plate of the component 521 absorbs and dissipate energy. The other plate(s) of the component 521 that do include at least one cutout may not yield when the load is applied to the component 521 thereby maintaining at least some of the strength of the component.

Figure 6:
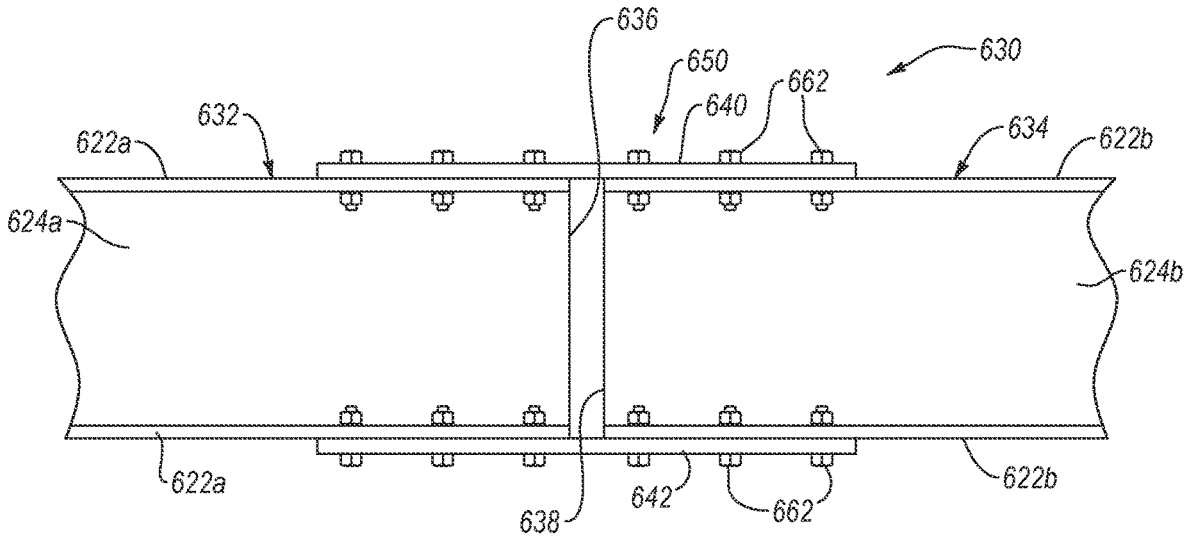
FIG. 6 is a side plan view of a portion of a frame, according to an embodiment.

As previously discussed, the structural fuses disclosed herein form part of frames. FIGS. 6-11 illustrate at least a portion of different frames that may include the structural fuses disclosed herein. FIG. 6 is a side plan view of a portion of a frame 630, according to an embodiment. The frame 630 includes a first beam 632 and a second beam 634. The first beam 632 is illustrated as an I-beam that includes two flanges 622*a* and a web 624*a* extending therebetween. The second beam 634 is also illustrated as an I-beam that includes two flanges 622*b* and a web 624*b* extending therebetween. It is noted that at least one of the first or second beam 632, 634 may include a hollowed structural sectioned beam or any other structural beam. The first beam 632 includes a first terminal end 636 and the second beam 634 includes a second terminal end 638 positioned adjacent to the first terminal end 636 of the first beam 632.

The first and second beams 632, 634 are attached together using a beam-to-beam connection system 650. The beam-to-beam connection system 650 includes at least one of a first plate 640 or a second plate 642. The first plate 640 may be attached to adjacent flanges 622*a*, 624*b* of the first and second beams 632, 634. The second plate 642 may be attached to adjacent flanges 622*a*, 624*b* of the first and second beams 632, 634 that are opposite the flanges 622*a*,

624*b* of the first and second beams 632, 634 that are attached to the first plate 640. The first and second plates 640, 642 are illustrated as being attached to the first and second beams 632, 634 using one or more bolts 662. However, the first and second plates 640, 642 may be riveted, welded, or otherwise attached to the first and second beams 632, 634.

At least one of the first or second plate 640, 642 may be any of the structural fuses disclosed herein. For example, at least one of the first or second plate 640, 642 may define at least one cutout that is configured to form one or more yield regions. In an embodiment, both the first and second plates 640, 642 are the structural fuses or only the first plate 640 is the structural fuse. In an embodiment, only the second plate 642 is the structural fuse. In such an embodiment, only the second plate 642 may be the structural fuse when a floor is formed on the frame 630 such that the floor is formed over the first plate 640. The floor may make accessing and repairing the first plate 640 difficult. However, the second plate 642 may be accessed and repaired through the ceiling which may be significantly easier than accessing and repairing the first plate 640 through the floor.

Figure 7:
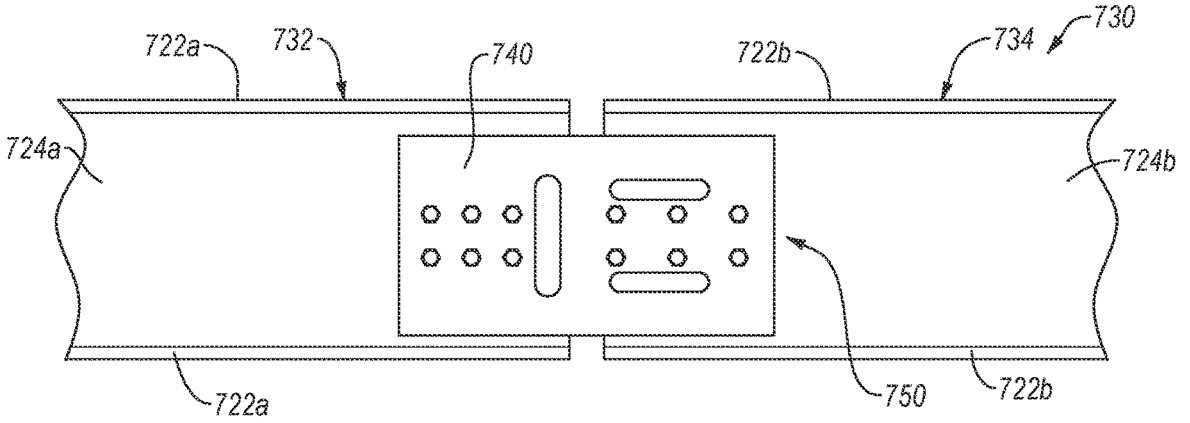
FIG. 7 is a side plan view of a frame, according to an embodiment.

The first and second plates 640, 642 may be attached to the web 624*a*, 624*b* of the first and second beams 632, 634 instead of or in addition to the flanges 622*a*, 622*b*. For example, FIG. 7 is a side plan view of a frame 730, according to an embodiment. Except as otherwise disclosed herein, the frame 730 is the same or substantially similar to the frame 630 illustrated in FIG. 6. For example, the frame 730 includes a first beam 732 and a second beam 734. The first beam 732 may be an I-beam that includes two flanges 722*a* and a web 724*a* extending between the two flanges 722*a*. The second beam 734 may also be an I-beam that includes two flanges 722*b* and a web 724*b* extending between the two flanges 722*b*. However, at least one of the first or second beam 732, 734 may include a hollowed sectional structural beam or another type of structural beam. The frame 730 also includes a beam-to-beam connection system 750 that includes at least one plate 740. The plate 740 may be attached to the webs 724*a*, 724*b* of the first and second beams 732, 734. The plate 740 may be the same or substantially similar to any of the structural fuses disclosed herein. For example, as illustrated, the plate 740 may be the same or substantially similar to the structural fuse 300 illustrated in FIG. 3A.

Figure 8A:
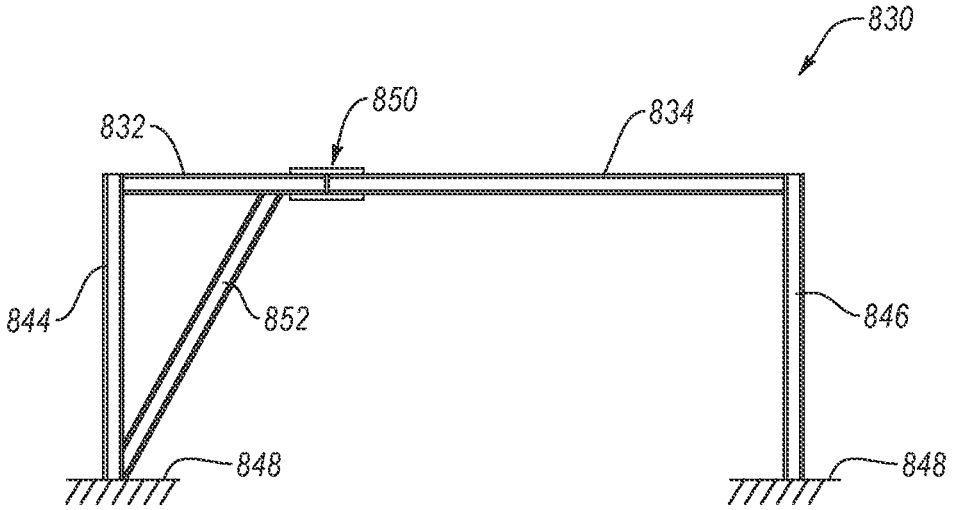
FIG. 8A is a side plan view of a frame, according to an embodiment.

FIG. 8A is a side plan view of a frame 830, according to an embodiment. The frame 830 includes a first column 844 and a second column 846. The first and second columns 844, 846 are illustrated as being attached to a surface 848 (e.g., ground, foundation, or another portion of the structure that includes the frame 830). The frame 830 includes a first beam 832 attached to and extending from the first column 844 and a second beam 832 attached to and extending from the second column 846. The first and second beams 832, 834 may be attached together using a beam-to-beam connection system 850. The beam-to-beam connection system 850 may be the same or substantially similar to any of the beam-to-beam connection systems disclosed herein. In other words, the beam-to-beam connection system 850 includes at least one structural fuse that is the same or substantially similar to any of the structural fuses disclosed herein. It is noted that, in an example, the first and second beam 832, 834 may be integrally formed together and the beam-to-beam connection system 850 is replaced with the structural fuse illustrated in FIG. 5A. The frame 830 may also include a brace 852 extending from a portion of the first column 844 that is spaced from the first beam 832 to a portion of the first beam 832 that is spaced from the first column 844. For example, the brace 852 may extend from a portion of the first column 844 that is at or near the first surface 848 to a portion of the first beam 832 that is at or near the beam-to-beam connection system 850.

Figure 8B:
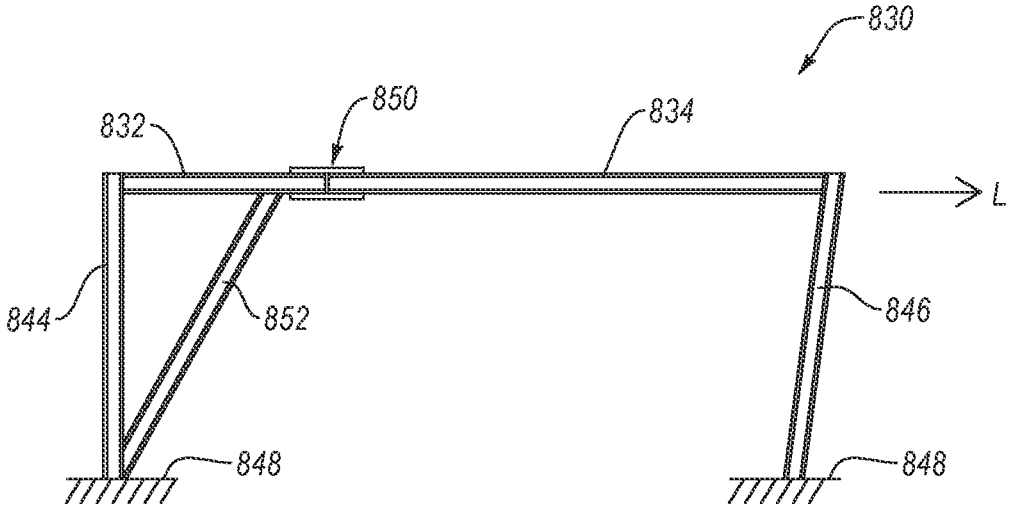
FIG. 8B is a side plan view of the frame illustrated in FIG. 8A when a load is applied to the frame, according to an embodiment.

FIG. 8B is a side plan view of the frame 830 illustrated in FIG. 8A when a load L is applied to the frame 830, according to an embodiment. The frame 830 and in particular the beam-to-beam connection system 850 with the structural fuse may allow precise control of the axial load transfer between the first and second beams 832, 834. Under the load F, the structural fuses of the beam-to-beam connection system 850 may yield in the longitudinal direction thereby preventing overload in the first and second beams 832, 834 and the brace 852. In other words, the beam-to-beam connection system 850 moves the yielding of the frame 830 from the first and second beams 832, 834 and the brace 852 (which is where the yielding would occur without the structural fuses) to the structural fuse(s) of the beam-to-beam connection system 850. The structural fuses of the beam-to-beam connection system 850 are much easier to replace that any one of the first beam 832, the second beam 834, or the brace 852.

Figure 9A:
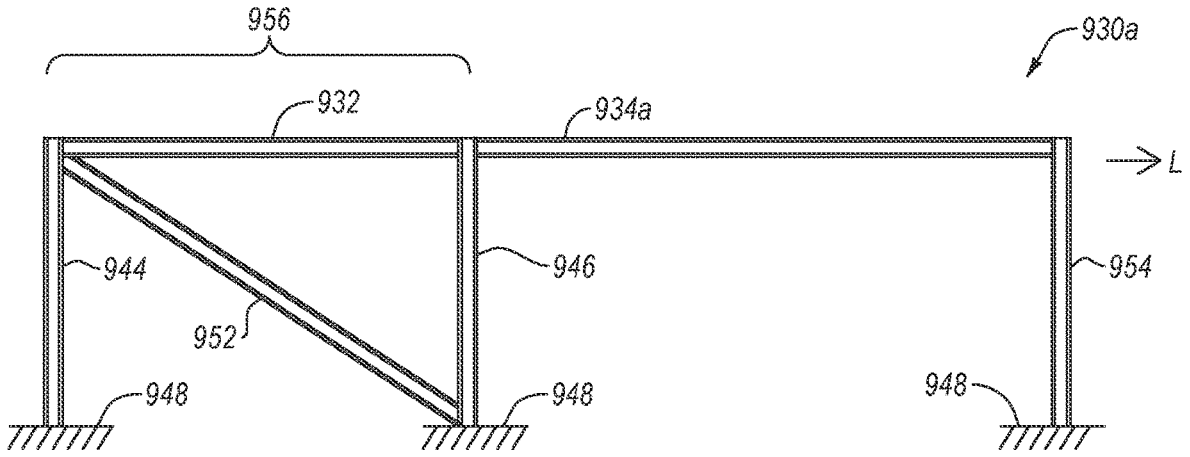
FIG. 9A is side plan view of a frame that does not include a structural fuse, according to an embodiment.

FIG. 9A is side plan view of a frame 930*a* that does not include a structural fuse, according to an embodiment. The frame 930*a* includes a first column 944, a second column 946, and a third column 954. The first, second, and third columns 944, 946, 954 are illustrated as being attached to a surface 948. The frame 930*a* includes a first beam 932 attached to and extending between the first and second columns 944, 946. The frame 930*a* includes a brace 952 extending between at least two of the first beam 932, the first column 944, the second column 946, or the surface 948. The first beam 932, the first column 944, the second column 946, and the brace 952 may form a lateral frame 956. The frame 930*a* also includes a second beam 934*a* attached to and extending between the second and third columns 946, 954. The second beam 934*a* may be known as a "collector" since it transmits a load L to the lateral frame 956. Transferring the load L to the lateral frame 956 may cause one or more components of the lateral frame 956, and in particular the brace 952, to yield. As such, the lateral frame 956 may be subjected to oversizing to prevent yielding of the components thereof or may require costly and difficult repairs to repair the yielded components.

Figure 9B:
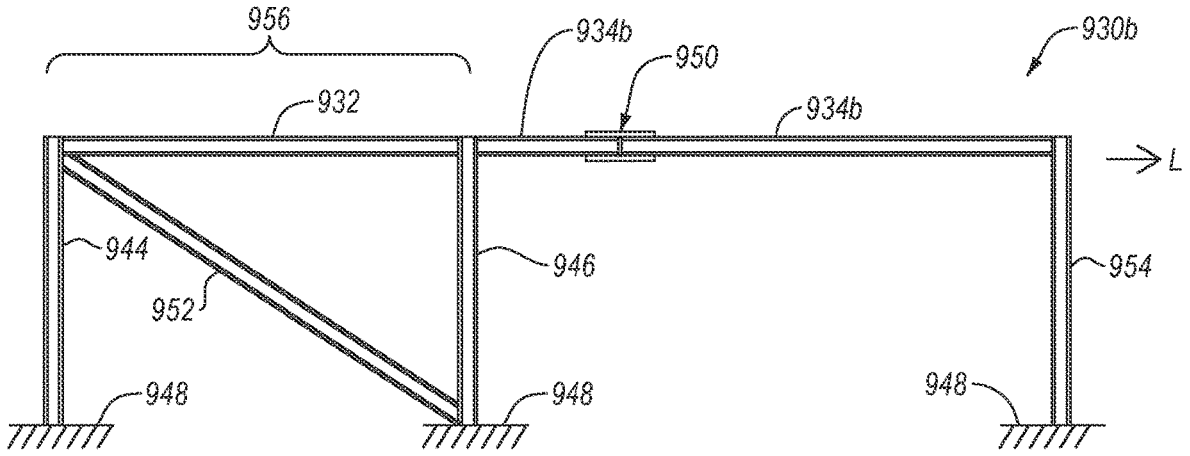
FIG. 9B is a side plan view of a frame that includes a structural fuse, according to an embodiment.

FIG. 9B is a side plan view of a frame 930*b* that includes a structural fuse, according to an embodiment. Except as otherwise disclosed herein, the frame 930*b* is the same or substantially similar to the frame 930*a* illustrated in FIG. 9A. For example, the frame 930*b* includes a lateral frame 956 that includes a first beam 932, a first column 944, a second column 946, and a brace 952. The frame 930*b* also includes a third column 954. However, instead of the single second beam 934*a* illustrated in FIG. 9A, the frame 930*b* includes one or more second beams 934*b* attached to and extending between second column 946 and the third column 954. The one or more second beams 934*b* may include a beam with a structural fuse formed therein (as illustrated in FIG. 5A) and/or a plurality of beams attached together using a beam-to-beam connection system 950 that includes one or more structural fuses. When the load L is applied to the frame 930*b*, the structural fuse of the second beam 934*b* (e.g., the structural fuse formed in the second beam 934*b* and/or the beam-to-beam connection system 950) may yield. In other words, yielding the structural fuse of the second beam 934*b* may absorb and dissipate energy that may otherwise cause the brace 952 or another component of the lateral frame 956 to yield. Repairing the frame 930*b* may be easier when the structural fuse of the second beam 934*b* yields, especially when the structural fuse forms part of the beam-to-beam connection system 950, than when the components of the lateral frame 956 yield.

Figure 10:
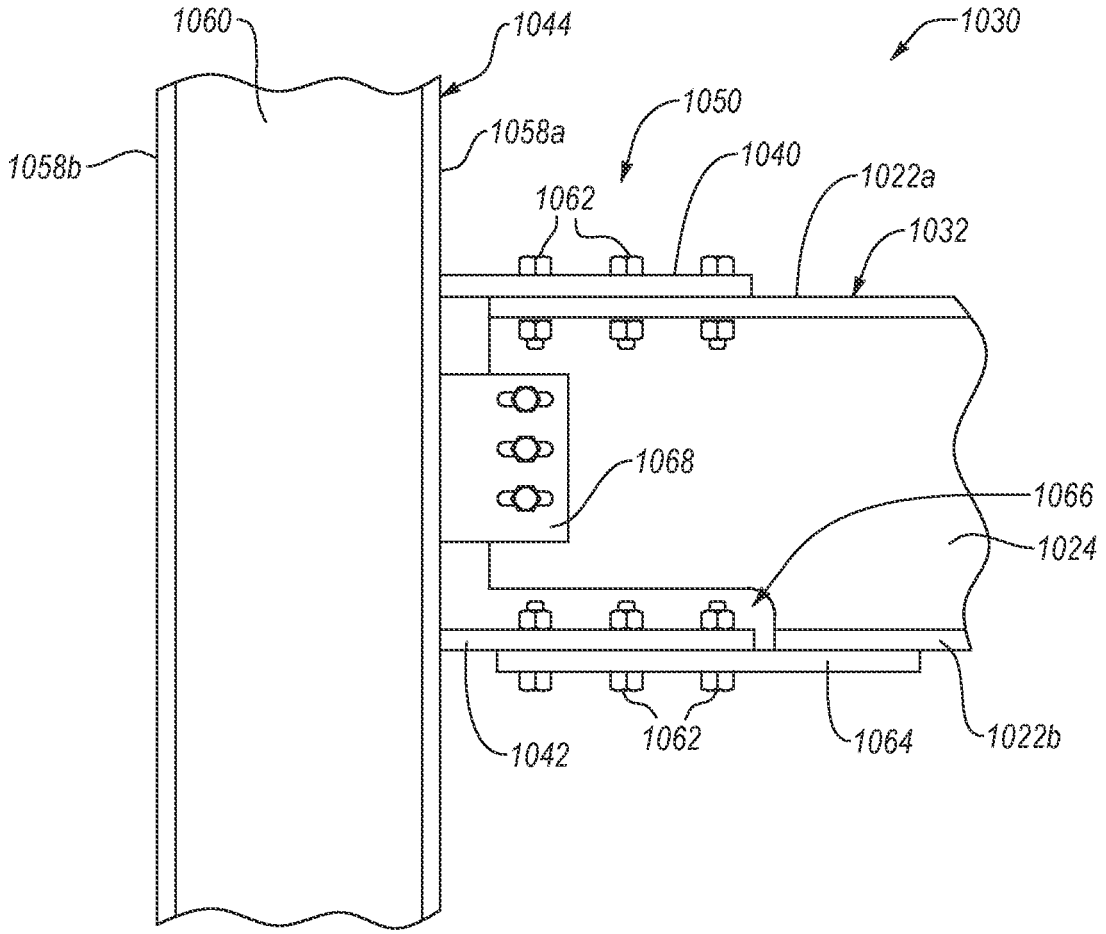
FIG. 10 is a side plan view of a portion of a frame, according to an embodiment.

FIG. 10 is a side plan view of a portion of a frame 1030, according to an embodiment. The frame 1030 includes a beam 1032. The beam 1032 is illustrated as being an I-beam that includes a top flange 1022*a*, a bottom flange 1022*b*, and a web 1024 extending between the top and bottom flanges 1022*a*, 1022*b*. However, it is noted that the beam 1032 may include a hollowed structural sectional beam, a T-beam, or any other type of structural beam. The frame 1030 also includes a column 1044. The column 1044 is illustrated as being an I-beam that includes a first flange 1058*a*, a second flange 1058*b*, and a web 1060 extending between the first and second flanges 1058*a*, 1058*b*. However, similar to the beam 1032, the column 1044 may include a hollowed structural sectional beam a T-beam, or any other type of structural beam.

The beam 1032 may be attached to the first flange 1058*a* of the column 1044 using a beam-to-column connection system 1050. The beam-to-column connection system 1050 includes a first plate 1040 and a second plate 1042 attached to the first flange 1058*a* of the column 1044. The first and second plates 1040, 1042 may be attached to the first flange 1058 using welding, bolts, rivets, or any other technique. The first plate 1040 is configured to be attached to the top flange 1022*a* of the beam 1032 using one or more bolts 1062 or any other attachment technique. In the illustrated embodiment, the first plate 1040 is directly attached to the top flange 1022*a* though, in some embodiments, the first plate 1040 may be indirectly attached to the top flange 1022*a*, such as via at least one additional plate. The second plate 1040 is configured to be attached, either directly or indirectly, to the bottom flange 1022*b* of the beam 1032 using any suitable technique. In the illustrated embodiment, when the second plate 1040 is indirectly attached to the bottom flange 1022*b*, the beam-to-column connection system 1050 includes a third plate 1064 directly attached (e.g., welded, bolted, etc.) to the bottom flange 1022*b* of the beam 1032. The third plate 1064 may be attached to the second plate 1042 using one or more bolts 1062, welding, or any other attachment technique. The beam 1032 may define a cutout 1066 that is configured to receive the second plate 1042. In some embodiments, the beam-to-column connection system 1050 also includes a shear tab 1068 attached to the first flange 1058*a* of the column 1044 and the web 1026 of the beam 1032.

One or more of the first plate 1040, the second plate 1042, or the third plate 1064 is a structural fuse (e.g., defines at least one cutout configured to form yield regions). For example, the third plate 1064 may include the structural fuse since the third plate 1064 may be easier to replace that the first or second plates 1040, 1042. The structural fuse may limit bending moments in the beam-to-column connection system 1050 and can prevent yielding of the beam 1032 and the column 1044 when a load (not shown) is applied to the frame 1030. Further, the structural fuse may change the governing limit state for the beam 1032, if necessary, so that plastic design procedures can be used in the frame 1050.

Figure 11:
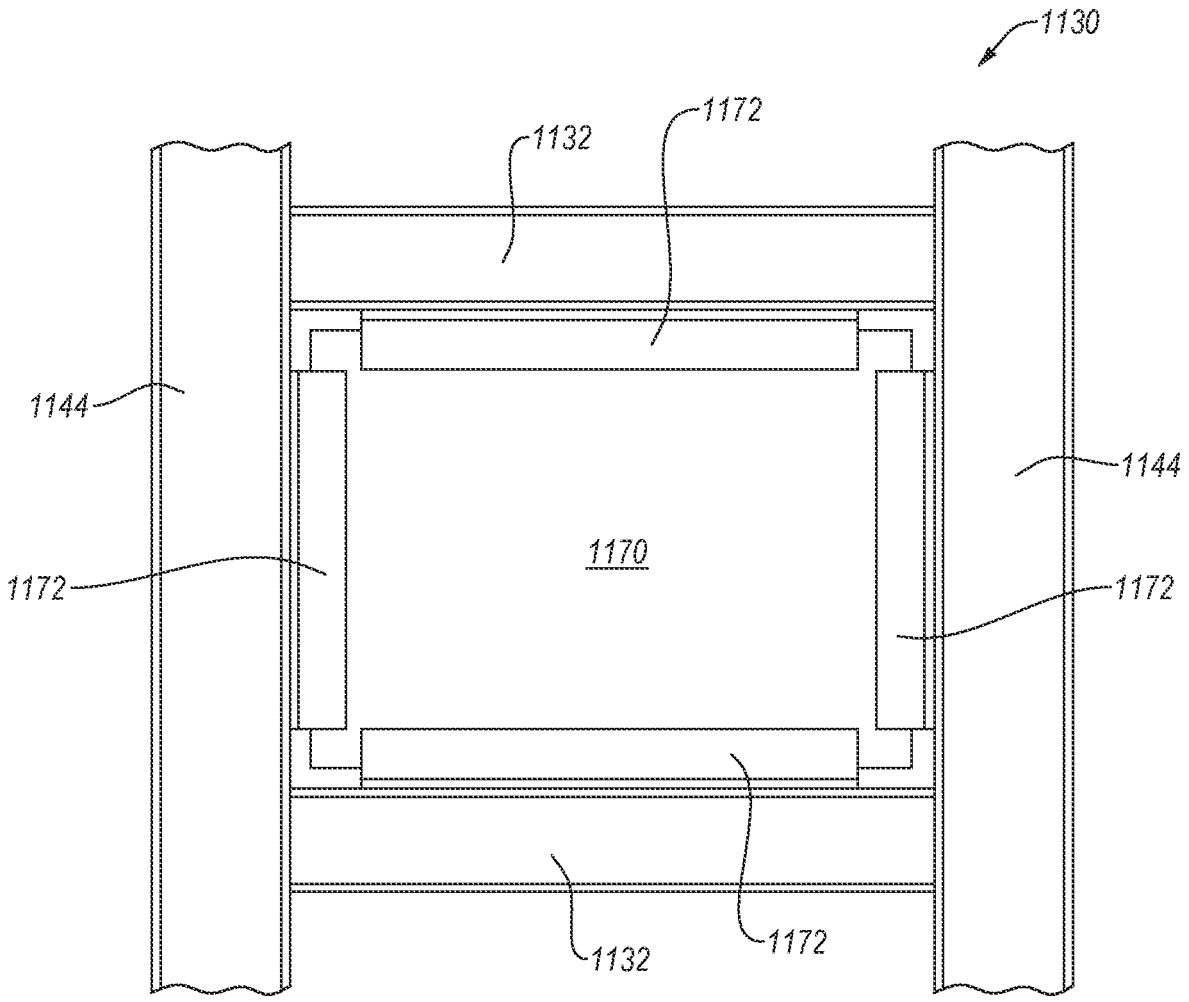
FIG. 11 is a side plan view of a frame, according to an embodiment.

FIG. 11 is a side plan view of a frame 1130, according to an embodiment. In particular, the frame 1130 is a plate shear wall, such as a steel plate shear wall. The frame 1130 includes two column 1144 spaced from each other. The frame 1130 also includes two beams 1132 extending between the two columns 1144 that are spaced from each other. The beams 1132 may be attached to the columns 1144 using any suitable technique, such as the beam-to-column connection system 1050 illustrated in FIG. 10 or any conventional means. The frame 1130 also includes a plate wall 1170 positioned in the space between the two beams 1132 and the two columns 1144. The plate wall 1170 may be formed from steel or any other suitable material.

The frame 1130 may include one or more mounts 1172 that are each attached to the plate wall 1170 and one of the beams 1132 or the columns 1144. For example, in the illustrated embodiment, the frame 1130 includes four mounts 1172 and each of the mounts 1172 are attached to one of the beams 1132 or the columns 1144 and the wall plate 1172. Each of the mounts 1172 may include a planar plate and/or an angle (i.e., an L-shaped beam). It is noted that attaching the plate wall 1170 to the beams 1132 and the columns 1144 with the mounts 1172 may decrease the cost of forming the shear plate wall than if the plate wall 1170 was attached to the beams 1132 and the columns 1144 using conventional techniques. At least one of the mounts 1172 is a structural fuse. That is, at least one of the mounts 1172 includes at least one cutout formed therein that form one or more yield regions.

A load applied to a conventional plate shear wall (e.g., a plate shear wall without a structural fuse) may cause the steel plate wall thereof to yield. Repairing the yielded steel plate wall is very difficult. However, a load applied to the frame 1130 may cause one or more of the mounts 1172 to yield instead of the plate wall 1170. Repairing the yielded mounts 1172 may be significantly easier and less expensive than repairing the plate wall 1170.

Further examples of connection systems (e.g., beam-to-beam and beam-to-column connection systems) that may use any of the structural fuses disclosed herein are disclosed in U.S. Provisional Patent Application No. 63/174,663 filed on Apr. 14, 2021, U.S. Pat. No. 10,689,876 filed on Aug. 10, 2018, U.S. Pat. No. 10,584,477 filed on Apr. 25, 2019, U.S. Pat. No. 10,316,507 filed on Aug. 26, 2015, U.S. Pat. No. 10,760,261 filed on Dec. 8, 2016, and International Application No. WO 2021/030111 filed on Aug. 5, 2020, the disclosures of each of which are incorporated herein, in its entirety, by this reference.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

What is claimed is:

1. A structural fuse, comprising:

at least one plate;

at least one first cutout located in a first portion of the at least one plate, the at least one first cutout partially defining at least one first yield region, the at least one first yield region configured to yield upon application of a first load to the plate; and at least one second cutout located in a second portion of the at least one plate, the at least one second cutout partially defining at least one second yield region, the at least one second yield region configured to yield upon application of a second load to the plate, wherein a substantial portion of the at least one first yield region is distinct from a substantial portion of the at least one second yield region;

wherein the first load is different from the second load.

2. The structural fuse of claim 1, wherein the at least one plate includes a single plate.

3. The structural fuse of the claim 1, wherein the at least one plate includes a plurality of plates attached together to form an angle.

4. The structural fuse of claim 1, wherein the at least one plate includes two flanges and a web extending therebetween.

5. The structural fuse of claim 1, wherein the at least one first yield region is between the at least one first cutout and an edge of the at least one plate.

6. The structural fuse of claim 1, wherein the at least one first yield region is between the at least one first cutout and the at least one second cutout.

7. The structural fuse of claim 1, wherein the at least one second cutout includes a plurality of second cutouts and the at least one second yield region is between adjacent ones of the plurality of cutouts.

8. The structural fuse of claim 1, wherein the at least one plate includes at least one first attachment region and at least one second attachment region.

9. The structural fuse of claim 8, wherein at least a portion of the at least one first yield region and the at least one second yield region are distinct from at least a portion of the first attachment region and the second attachment region.

10. The structural fuse of claim 1, each of the at least one first cutout and the at least one second cutout exhibits an elongated shape.

11. The structural fuse of claim 10, wherein a longitudinal axis of the at least one first cutout extends in a first direction and a longitudinal axis of the at least one second cutout extends in a second direction.

12. The structural fuse of claim 10, wherein a longitudinal axis of the at least one first cutout and a longitudinal axis of the at least one second cutout are substantially parallel.

13. A frame, comprising:

a first component;

a second component; and a connection system attaching the first component to the second component, the connection system including at least one structural fuse, the at least one structural fuse including:

at least one plate;

at least one first cutout located in a first portion of the at least one plate, the at least one first cutout partially defining at least one first yield region, the at least one first yield region configured to yield upon application of a first load to the plate; and at least one second cutout located in a second portion of the at least one plate, the at least one second cutout partially defining at least one second yield region, the at least one second yield region configured to yield upon application of a second load to the plate, wherein a substantial portion of the at least one first yield region is distinct from a substantial portion of the at least one second yield region;

wherein the first load is different from the second load;

wherein the first component and the second component are independently selected from a beam, a column, or a wall plate.

14. A frame, comprising:

a first component;

a second component; and a connection system attaching the first component to the second component, the connection system including at least one structural fuse, the at least one structural fuse including:

at least one plate;

at least one first cutout located in a first portion of the at least one plate, the at least one first cutout partially defining at least one first yield region, the at least one first yield region configured to yield upon application of a first load to the plate;

at least one second cutout located in a second portion of the at least one plate, the at least one second cutout partially defining at least one second yield region, the at least one second yield region configured to yield upon application of a second load to the plate, wherein at least a portion of the at least one first yield region is distinct from at least a portion of the at least one second yield region;

wherein the first load is different from the second load;

wherein the first component is a beam and the second component is a beam or a wall plate.

15. The frame of claim 14, wherein the second component is a wall plate.

16. The frame of claim 14, wherein the second component is a beam.

17. The frame of claim 16, wherein the at least one structural fuse is attached to a bottom flange of the beam of the first component and a bottom flange of the beam of the second component.

18. The frame of claim 14, further comprising at least one column.

19. The frame of claim 18, wherein:

the at least one column includes a first column and a second column;

the beam of the first component is attached to the first column;

the second component includes a beam that is attached to the second column;

the at least one structural fuse attaches the beam of the first component to the beam of the second component.

20. The frame of claim 18, further comprising a lateral frame attached to the beam of the first component.

* * * * *